United States Patent [19]

Detweiler

[11] Patent Number: 5,044,678

[45] Date of Patent: Sep. 3, 1991

[54] SOLENOID OPERATED LATCH DEVICE WITH MOVABLE POLE PIECE

[75] Inventor: Charles A. Detweiler, Durand, Mich.

[73] Assignee: Lectron Products, Inc., Rochester Hills, Mich.

[21] Appl. No.: 558,072

[22] Filed: Jul. 25, 1990

[51] Int. Cl.[5] ..... E05C 1/12

[52] U.S. Cl. ..... 292/144; 296/97.22; 292/DIG. 60; 292/DIG. 40

[58] Field of Search ..... 292/144, 341.18, 341.16, 292/DIG. 60, DIG. 40; 296/97.22

[56] References Cited

U.S. PATENT DOCUMENTS

| | | | |
|---|---|---|---|
| 1,278,254 | 9/1918 | Taylor | 292/341.18 |
| 1,958,019 | 5/1934 | Reasoner | 292/144 |
| 2,535,444 | 12/1950 | Miller | 292/341.18 |
| 4,277,094 | 7/1981 | Rove | 296/97.22 |
| 4,458,930 | 7/1984 | Goike et al. | 296/97.22 |
| 4,540,154 | 9/1985 | Kolchinsky et al. | 335/261 |
| 4,811,984 | 3/1989 | Hempel | 296/97.22 |
| 4,917,418 | 4/1990 | Gokee | 296/97.22 |
| 4,971,370 | 11/1990 | Detweiler et al. | 292/DIG. 43 |

*Primary Examiner*—Gary L. Smith
*Assistant Examiner*—Darnell M. Boucher
*Attorney, Agent, or Firm*—Harness, Dickey & Pierce

[57] ABSTRACT

A remotely actuated solenoid latch apparatus adapted for use in motor vehicle applications is disclosed. The solenoid latch apparatus includes a solenoid having an armature movable between a first position displaced from a pole piece to define a working air gap therebetween to a second position attracted toward the pole piece. A solenoid winding encircles the pole piece and the armature for attracting the armature toward the pole piece upon energization thereof. A latch member is associated with the movable armature for lockingly engaging a striker bar when the armature is in one position and releasably disengaging the striker bar when the armature is in the other position. The present invention is self-compensating to align the latch member relative to the striker bar, prior to engagement therewith, to compensate for alignment variation between the latch member and the striker bar. The pole piece is movable to provide a relatively constant air gap upon alignment of the latch member relative to the striker bar when the armature is displaced from the pole piece.

32 Claims, 3 Drawing Sheets

SOLENOID OPERATED LATCH DEVICE WITH MOVABLE POLE PIECE

BACKGROUND AND SUMMARY OF THE INVENTION

The present invention relates to automotive latching devices and, in particular, to a solenoid device having an alignment compensating latch which is particularly adapted for use with a fuel filler door latch system to inhibit unauthorized access to a fuel tank.

In an effort to inhibit unauthorized access to a vehicle's fuel tank, automobile manufacturers are evaluating various fuel filler door latching systems. Conventionally, latching systems have included the use of a striker bar fixed to the filler door and a latch member ("bolt") mounted to the vehicle body. The latch member engages the striker bar in a "latched" position when the filler door is closed. To release the fuel filler door, the latch member is moved to an "unlatched" position to disengage the striker bar, thereby allowing the fuel filler door to open freely for access to the fuel cap.

As a convenience option, vehicle manufacturers are installing remotely actuated fuel filler door latch release systems. Remotely actuated latching systems permit an occupant within the passenger compartment of the vehicle to open "unlatch" the fuel filler door prior to exiting the vehicle. Typically, remotely actuated latching systems include the use of a linear actuation cable or linkage coupled to the latch member for manually releasing the filler door. In general, a vehicle occupant pulls a release handle located within the passenger compartment to operatively move the latch member out of engagement with the striker bar. Alternatively, many vehicles are now being equipped with electrically actuated release systems. These systems typically include a solenoid device mounted remote from the fuel filler area, and a linkage or actuation cable coupled between a movable solenoid armature and the latch member. Energization of the solenoid moves the armature and, consequently, the latch member to disengage the striker bar.

Because the fuel filler door is a cosmetic "fit and finish" component of an automobile, it must be precisely aligned during assembly. It is common for conventional fuel filler latching mechanisms to require adjustment of the alignment between the latch member and the striker bar following vehicle assembly to ensure that the release system will function properly.

A disadvantage associated with "prior art" solenoid operated fuel filler latching mechanisms is the excessive armature travel ("stroke") required to assure adequate system reliability. Conventional solenoid actuated release systems must generate sufficient armature travel to account for any dimensional and alignment variations associated with the components making up a fuel filler door assembly and latch mechanism. Specifically, the anticipated range of alignment variability between the location of the striker bar and the latch member must be taken into account in determining the amount of armature stroke required. As is known in solenoid design, it is an inherent characteristic that the magnetic attractive force produced by a solenoid device decreases as its armature travel increases. Consequently, to assure adequate movement of the latch member to release the striker bar, it is necessary to provide a relatively large and expensive solenoid to generate the sufficient force output.

Accordingly, it is a primary object of the present invention to overcome the disadvantages of the prior art and to provide an improved solenoid device having means for compensating for variations in the alignment of the striker bar relative to a latching member. In particular, the present invention includes a self-compensating solenoid apparatus operable to minimize the effects of alignment variations between the striker bar and an integral latch member.

In general, this is accomplished by providing a solenoid actuated latch apparatus having a movable pole piece adapted to bias a position compensating guide member to a normally protracted position. The guide member coacts with a latch bolt for aligning the latch bolt with respect to the striker bar to compensate for alignment variations therebetween. In particular, when the striker bar contacts the guide member, the guide member is retracted for producing corresponding movement of the pole piece. In addition, retraction of the guide member also produces corresponding movement of the latch bolt to maintain a desired axial relationship between the latch bolt and the guide member prior to engagement of the latch bolt with the striker bar. In this manner, engagement of the movable guide member with the striker bar acts to compensate for alignment variations between the striker bar and the latch member. The present invention is a compact solenoid assembly having a self-compensating latching components associated therewith. The solenoid assembly can be mounted to a fuel filler housing to define a fuel filler housing assembly which can be readily installed as a sub-assembly into a vehicle.

The self-compensating characteristic of the present invention permits the magnetic attractive force requirement for a solenoid to be predicated on a substantially reduced amount of armature travel. Because alignment variations associated with the striker bar can be compensated for without impacting solenoid armature travel requirements, the travel requirement and therefore, the size of the solenoid can be substantially reduced. In this manner, the overall size, weight, and cost of the solenoid can be reduced.

To release the striker bar, the solenoid assembly of the present invention is energized to move the latch bolt out of engagement with the striker bar. Consequently, the present invention provides increased system reliability, is relatively simple and inexpensive to manufacture, and is convenient for subassembly into a vehicle.

Additional objects, advantages, and features of the present invention will become apparent from a reading of the following detailed description and appended claims, taken in conjunction with the accompanying drawings.

DETAILED DESCRIPTION OF THE PREFERRED EMBODIMENTS

Figure 1:
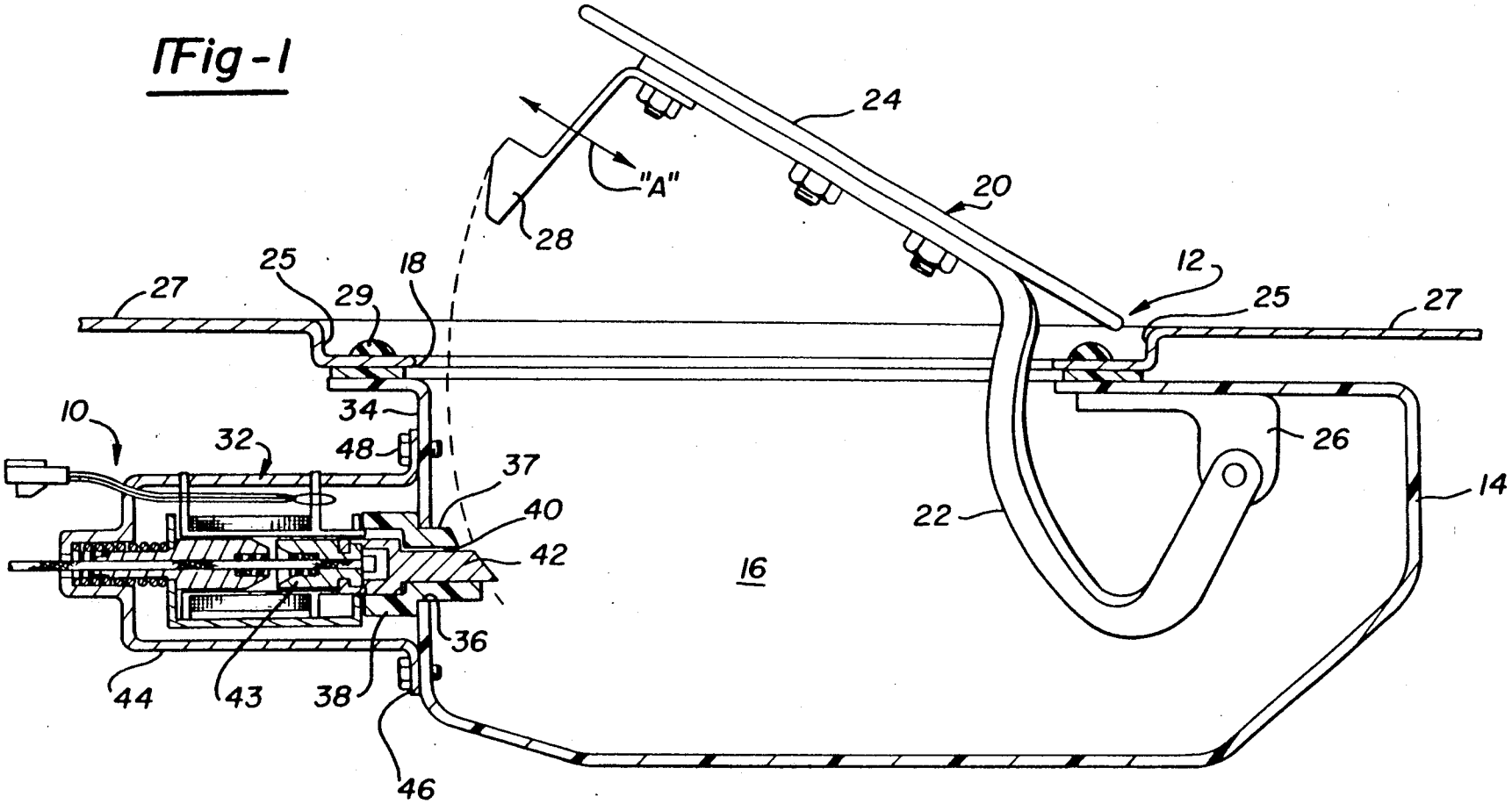
FIG. 1 is a section view of a self-compensating solenoid assembly installed in a fuel filler housing assembly according to a preferred embodiment of the present invention.

Referring to FIG. 1 of the drawings, a sectional view of a self-compensating solenoid apparatus 10 operatively installed in a fuel filler housing assembly 12 according to the preferred embodiment of the present invention is shown. While the present invention is illustrated as part of a fuel filler door system, it will be appreciated by those skilled in the art that self-compensating solenoid apparatus 10 is readily adaptable for use in any motor vehicle latching application. Fuel filler housing assembly 12 includes a housing 14 defining a chamber 16 therein and which is provided with an opening 18 to provide access to a fuel cap (not shown). Housing 14 is made of a material which is preferably resistant to the corrosive effects of gasoline and, more preferably, is fabricated of a blow molded high density polyethylene (HDPE) material. A door assembly 20 including a pivotable hinge member 22 and a door 24 mounted thereto is provided to enclose access opening 18 when door assembly 20 is swung to a closed position. Preferably, housing assembly 12 is mounted within a recessed portion of a motor vehicle such that door 24 has a high quality "fit and finish" within an offset surface 25 of exterior body panel 27 following assembly. Door 24 is adapted to engage one or more resilient bumpers 29 affixed within offset surface 25 upon being moved to the closed position. Attached to hinge 22, opposite pivot joint 26, is a striker bar 28 which is provided for lockingly engaging the self-compensating latch components of solenoid apparatus 10 to lock door 24 in a closed "latched" position. The generally arcuate swing path of door 24 and, consequently, striker bar 28 is illustrated in FIG. 1. Moreover, arrow "A" depicts the general direction of alignment variation associated with striker bar 28 which is accounted for by self-compensating solenoid apparatus 10. The function, structure and operation of self-compensating solenoid apparatus 10 will be hereinafter described in greater detail.

In general, the present invention includes a solenoid assembly 32 adapted to be mounted to a generally planar outer side wall 34 of housing 14. Housing 14 has an aperture 36 extending through side wall 34 through which a portion of the self-compensating components of solenoid 32 extends so as to be partially disposed within chamber 16. In particular, an outer surface portion 37 of a movable tubular guide member 38 is movably disposed in aperture 36 to extend into chamber 16. Guide member 38 has a central passage 40 in which a movable latch bolt 42 is disposed so as to extend out of guide member 38 and into chamber 16 and which is adapted to lockingly engage striker bar 28. In general, latch bolt 42 is associated with a movable armature 43 of solenoid assembly 32 such that latch bolt 42 is adapted to lockingly engage striker bar 28 when armature 43 is in first "latched" position. The "latched" position is defined a by latch bolt 42 being axially "extended" into chamber 16 with respect to guide member 38. Likewise, latch bolt 42 is adapted to disengage striker bar 28 to release door 24 when armature 43 is moved to a second "unlatched" position. The "unlatched" position is defined by latch bolt 42 being axially "retracted" into central passage 40 of guide member 38. Guide member 38 is adapted to align latch bolt 42 in a predetermined axial position with respect to striker bar 28 for providing the self-compensating characteristics of the present invention.

Solenoid assembly 32 includes a generally cylindrical protective housing 44 having an open end defining a radially outwardly extending flange 46. Solenoid assembly 32 is mounted to side wall 34 via means such as bolt 48 passing through mounting bores (not shown) provided in radial flange 46. The opposite end of housing 44 defines a generally closed end portion 50. Fixedly disposed within housing 44 is a bobbin 52 having a plurality of coil windings 54 wound thereon. Bobbin 52 is fabricated from a non-magnetic material and, preferably, is made of a nylon-type material. Bobbin 52 defines a hollow center core 56 through which a magnetic pole piece 58 and magnetic armature 43 are movably disposed. In particular, coil bobbin 52 encircles pole piece 58 and armature 43 and forms a pair of axially separated radial flanges 62 and 64.

Magnetic pole piece 58 is disposed for axial movement within central core 56 of bobbin 52. Pole piece 58, in turn, has a first end forming a generally convex frusto-conical surface 66 into which an axial bore 68 extends. The opposite end of pole piece 58 includes a section of reduced cross-section defining an integral pin-like extension 70. The interface between pole piece 58 and its pin-like extension 70 defines a radially outwardly extending shoulder 71.

Magnetic armature 43, which in the preferred embodiment is made of steel, is movable in an axial direction through a limited range of travel within central core 56 of bobbin 52. Armature 43 has one end defining a generally concave frusto-conical surface 72. An axial bore 74 is formed through surface 72 such that bores 74 and 68 are axially aligned. A first helical spring 86 is disposed within the axially aligned bores 68 and 74 to bias armature 43 in a direction away from pole piece 58. The opposite end of armature 43 is coupled to latch bolt 42 within a central chamber 41 formed within latch bolt 42. Latch bolt 42 is configured to define a radially outward extending shoulder 78. Latch bolt 42 terminates in a tapered camming surface 80 which extends through central passage 40 and into chamber 16. Camming surface 80 is adapted to engage striker bar 28 upon door 24 being moved toward a closed position. Latch bolt 42 is configured to axially move within passage 40 of guide member 38 upon movement of armature 43. Shoulder 78 is adapted to abut a complimentary radial shoulder 82 defined in a recessed cup-like portion of guide member 38 for limiting the axial biasing of armature 43 in a direction away from pole piece 58. In this manner, shoulder 82 is adapted to maintain a predetermined orientation between camming surface 84 provided on an upper exterior portion of guide member 38 and latch bolt camming surface 80 regardless of the axial position of guide member 38 in aperture 36. This maintained orientation is clearly illustrated in FIGS. 2 and 4. In particular, first spring 86 urges shoulder 78 of latch bolt 42 into contact with shoulder 82 of guide member 38 to maintain the axial relationship between guide member camming surface 84 and latch bolt camming surface 80.

A generally U-shaped magnetic strap member 100 having a first upstanding flange segment 102 at one end surrounds an axially extending outer surface 104 of bobbin 52 adjacent bobbin flange 64. Flange segment 102 is disposed on surface 104 between bobbin flange 64 and a planar end surface 106 of guide member 38. Preferably, guide member end surface 106 is secured to flange segment 102 such that axial translational movement of guide member 38 produces corresponding movement of U-shaped strap 100. The opposite end of strap 100 has a second upstanding flange segment 108 which abuts shoulder 71 of pole piece 58. Flange segment 108 is, preferably, secured to shoulder 71 of pole piece 58 to enable pole piece 58 to be axially movable upon corresponding axial movement of guide member 100. A second helical spring 110 is disposed between second flange segment 108 and inner surface of closed end 50 of housing 44. Preferably, closed end 50 of housing 44 includes a recessed spring holder 112 configured generally as a concave boss in which a portion of second helical spring 110 is disposed. An actuation cable 113 passes through spring holder 112, a bore 114 in housing 44, axial bores 116 and 68 in pole piece 58, and axial bores 118 and 74 in armature 43 and is secured within chamber 41 of latch bolt 42. Cable 113 is provided for manually moving (i.e., pulling) latch bolt 42 out of engagement with striker bar 28 if such occasion arises.

In general, solenoid 32 is energized by current flow through coil windings 54. The magnetic flux path of solenoid 32 is defined by pole piece 58, armature 43, and U-shaped strap member 100. The primary air-gap of solenoid 32 is defined by the complimentary tapered frusto-conical surfaces 66 and 72 for generating a desired attractive magnetic force capable of moving armature 43, and consequently, latch bolt 42 in a direction toward pole piece 58. Preferably, coil windings 54 are electrically interfaced to a switch in the passenger compartment via electrical leads 120. An electrical connector 122 is provided at the end of leads 120 to provide the electrical interface.

Figure 2:
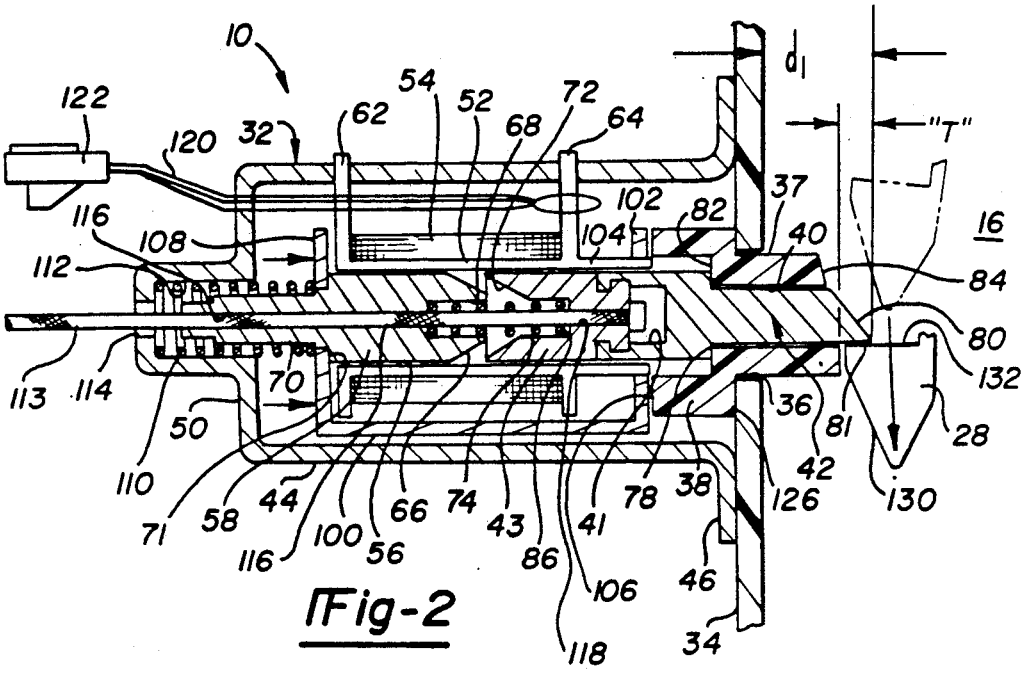
FIG. 2 is an enlarged view of FIG. 1 illustrating a "latched" condition when the striker bar is in a first displaced alignment relative to the fuel filler housing.
Figure 3:
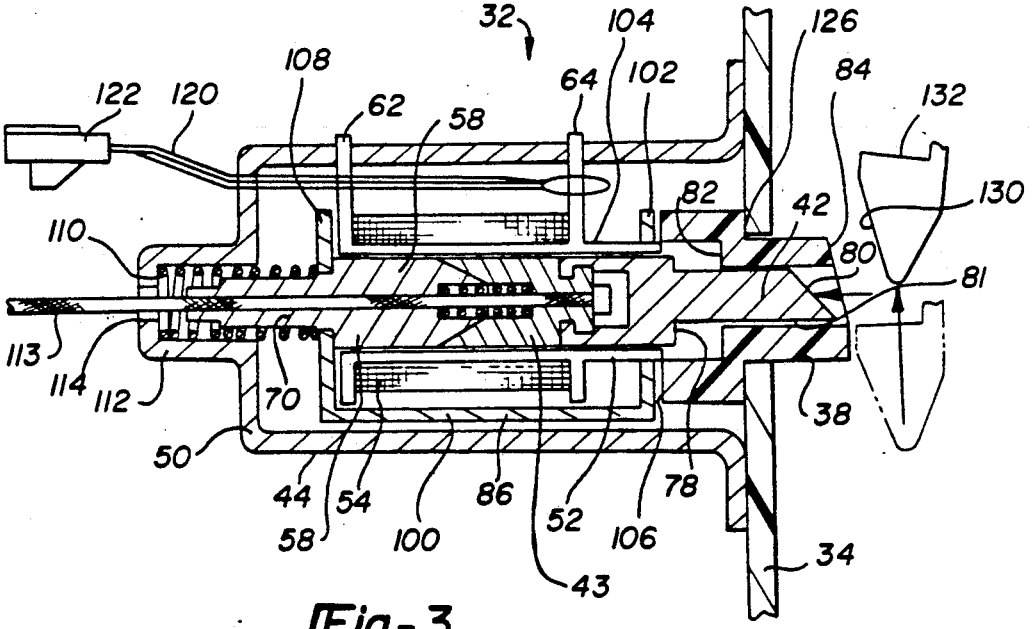
FIG. 3 is a section view, similar to FIG. 2, illustrating the operative relationship of the components of the present invention in an "unlatched" position.

With particular reference to FIGS. 2 and 3, the components of solenoid assembly 32 are operatively illustrated when striker bar 28 is displaced to a first alignment position "$d_1$" relative to an inner surface of side wall 34. Alignment position "$d_1$" represents the maximum alignment variation through which latch bolt 42 is adapted to lockingly engage striker bar 28 to maintain door 24 in a closed "latched" position. More particularly, FIG. 2 illustrates the relationship of the components when solenoid 32 is "de-energized" such that striker bar 28 is shown in the "latched" position relative to latch bolt 42. In the displaced alignment shown, second spring 110 urges strap 100 in a direction toward bobbin flange 62 to position pole piece 58 relative to armature 43. The magnetic attractive force between pole piece 58 and armature 43 is less than the biasing force of first helical spring 86 acting on armature 43. Therefore, first spring 86 urges armature 43 and, in turn, shoulder 78 of latch bolt 42 into contact with shoulder 82 of guide member 38. In this fashion first spring 86 maintains a uniformed predetermined air-gap distance between frusto-conical surfaces 66 and 72. In addition, strap member 100 urges guide member 38 in a direction toward striker bar 28. More specifically, the cup-shaped portion of guide member 38 defines a radial outer flanged surface 126 which is urged against outer housing wall 34 to limit the axial movement of guide member 38 in a direction toward striker bar 28.

As is seen in FIGS. 2 and 3, when door 24 is swung toward a closed position, a camming surface 130 provided on striker bar 28 engages tapered camming surface 80 of the latch bolt 42. In the displaced alignment shown, striker bar 28 does not initially contact camming surface 84 of guide member 38 prior to contacting latch bolt 42. Latch bolt 42 is maintained, prior to contact with striker bar 28, in the axially extended position shown since second spring 110 urges U-shape strap 100 and, consequently, guide member flange surface 126 against side wall 34. Thereafter, the force exerted by striker bar 28 upon contact with latch bolt camming surface 80 urges latch bolt 42 to move in a direction toward pole piece 58, in opposition to the biasing force exerted by first spring 86. Once striker bar camming surface 130 moves past latch bolt camming surface 80, first spring 86 urges latch bolt 42 to move axially toward striker bar 28 to lockingly engage surface 132 of striker bar 28 against a complimentary engaging surface 81 of latch bolt 42.

Referring now to FIG. 3, the orientation and cooperation of solenoid apparatus 32 when coil windings 54 are "energized" is illustrated. As shown, armature 43 is magnetically attracted toward pole piece 58 by the induced magnetic field produced by windings 54. In this position, latch bolt 42 is axially retracted into axial passage 40 of guide member 38 to permit surface 132 of striker bar 28 to be releasably disengaged from latch bolt engaging surface 81. Latch bolt 42 is retracted a distance "T" (shown in FIG. 2) such that the distal end of latch bolt camming surface 80 is disposed within passage 40 of guide member 38. This distance of retraction "T" corresponds approximately to the armature travel which solenoid 32 must generate to effectively release striker bar 28. The biased interaction of U-shaped strap 100 and guide member 38 maintains flange surface 126 of guide member 38 against housing side wall 34 during retraction of latch bolt 42. In particular, second helical spring 110 has a predetermined biasing force which is, preferably, greater than the biasing force of first spring 86. In this manner, upon energization of windings 54, armature 43 is attracted toward pole piece 58. Therefore, pole piece 58 is maintained in a generally stationary position relative to armature 43 when windings 54 are energized. While the preferred air-gap configuration illustrated is defined by frusto-conical surfaces 66 and 72, it is contemplated that other working air-gap configurations such as planar air-gap surfaces could be readily utilized. Energization of solenoid 32 is selectively controlled from a switch in the passenger compartment for exerting the magnetic attractive force between pole piece 58 and armature 43 in opposition to the biasing force of first spring 86.

Figure 4:
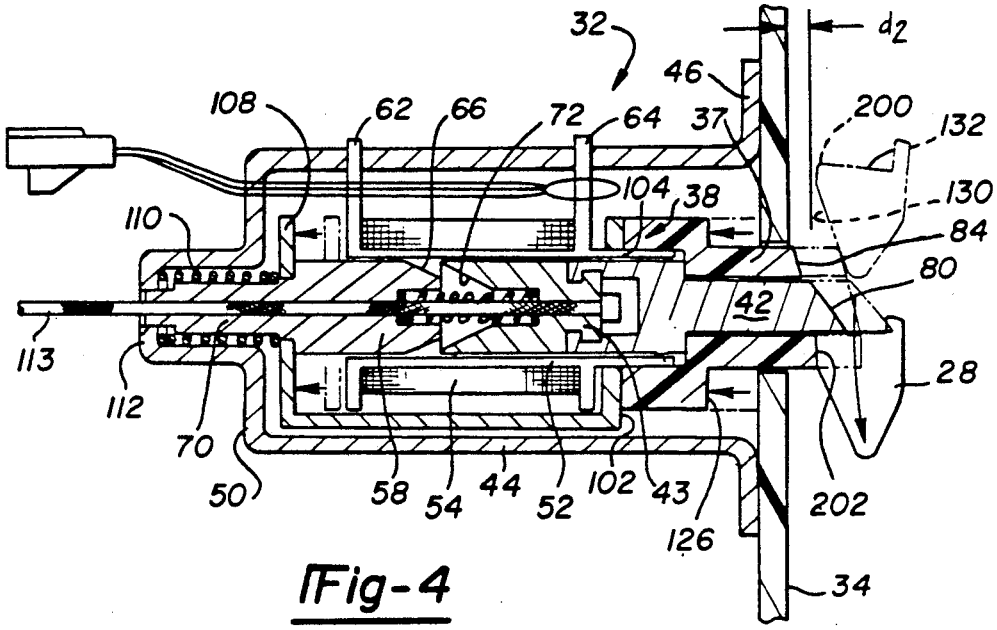
FIG. 4 is a section view, illustrating the operative association of the components in a "latched" position when the striker bar is in a second displaced alignment relative to the housing.
Figure 5:
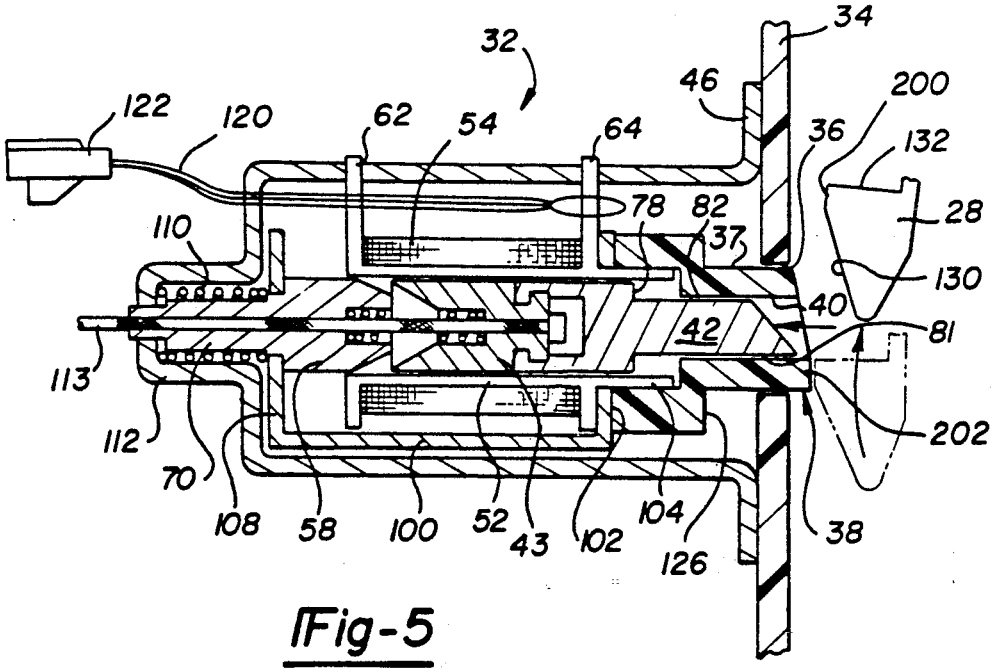
FIG. 5 is a section view, similar to FIG. 4, illustrating the "unlatched" position.

Referring now to FIGS. 4 and 5, the principles of the self-compensating characteristic of the present invention will now be described. FIGS. 4 and 5 illustrate the striker bar 28 aligned relative to side wall portion 34 at a distance designated hereinafter as "$d_2$". The present invention compensates for all variations in striker bar alignment with respect to latch bolt 42 encompassed within a range defined the distance "$d_1$". It is to be understood that the dimension of "$d_1$", "$d_2$" and "T", illustrated in the drawings are merely exemplary and are not to be construed to scale or otherwise limit the actual alignment variation range for which the present invention is capable of compensating.

With particular reference now to FIG. 4, the orientation and operation of the components of solenoid 32 when coil windings 54 are "de-energized" is illustrated. As is similar to FIG. 2, striker bar 28 is maintained in a "latched" position by latch bolt 42 to maintain door 24 in a closed position. Likewise, surface 200 provided on striker bar 28 exerts a axial force on a complimentary mating terminal end surface 202 provided on guide member 38 to assist in maintaining striker bar 28 in a closed position. In this manner, guide member 38, strap member 100 and pole piece 58 are axially moved in a direction opposing the biasing force of second spring 110. In addition, first spring 86 urges latch bolt shoulder 78 against guide member shoulder 82 to bias latch bolt 42 away from pole piece 58. FIG. 4 illustrates (in phantom) striker bar camming surface 130 as it initially contacts guide member camming surface 84 prior to contact with latch bolt camming surface 80. Specifically, upon contact with guide member camming surface 84, the force exerted on guide member 38 by striker bar 28 acts to axially "retract" guide member 38 and, consequently, U-shaped strap 100 and pole piece 58 in a direction against the biasing force of second spring 110. Likewise, shoulder 82 acts on latch bolt shoulder 78 to correspondingly axially move latch bolt 42 and, in turn, armature 43 simultaneously with the retracted movement of the other components. In this manner, the relative air-gap spacing between frusto-conical surfaces 66 and 72 is maintained. Likewise, the relative orientation between guide member camming surface 84 and latch bolt camming surface 80 is maintained as previously described. Thereafter, striker bar camming surface 130 contacts latch bolt camming surface 80 until, upon continued closing motion, striker bar camming surface 130 passes engaging surface 81 of latch bolt 42. Thereafter, first spring 86 is able to displace armature 43 in an axial direction away from pole piece 58, so as to correspondingly protract latch bolt 42 for lockingly engaging surface 132 of striker bar 28 on latch bolt engaging surface 81.

Referring now to FIG. 5, the "energized" position when the alignment displacement is "$d_2$" is illustrated. In this position, armature 43 is magnetically attracted toward pole piece 58 by the induced magnetic field produced by the windings 54. In this "unlatched" position, the energized solenoid 32 acts to axially "retract" latch bolt 42 a distance "T" to disengage striker bar 28. Following movement of door assembly 22 away from latch bolt 42, the present invention will return to the fully extended position illustrated in FIG. 1. That is, the combined spring forces of springs 86 and 110 act to displace U-shaped strap 100 and consequently, guide member 38 and latch bolt 42 into chamber 16 to a maximum extent.

In this manner, the travel requirement of armature 43 relative to pole piece 58 is reduced to "T" for disengaging striker bar 28 from latch bolt 42 regardless of the original alignment displacement between striker bar 28 and latch bolt 42. More specifically, the present invention permits compensation for alignment variability prior to engagement of striker bar 28 with latch bolt 42. In this manner, the armature travel required is substantially reduced as compared to prior art systems which require solenoid devices capable of providing an armature travel equal to or greater than displacement "$d_1$".

While the above description constitutes the preferred embodiment of the present invention, it will be appreciated that the invention is susceptible to modification, variation and change without departing from the proper scope or fair meaning of the accompanying claims. In particular, it is contemplated that the present invention may be used for any vehicular latch application which requires engagement between a striker bar and a latching member.

What is claimed is:

1. A remotely actuated solenoid latch apparatus adapted to be mounted to a motor vehicle structure and engagable with a striker bar, comprising:

a pole piece;

an armature movable between a first position displaced from said pole piece so as to define a working air gap therebetween to a second position attracted toward said pole piece;

a solenoid winding encircling said pole piece and said armature for attracting said armature to said second position through energization of said winding;

latch means associated with said movable armature for lockingly engaging the striker bar when said armature is in one of said first and second positions and releasably disengaging the striker bar when said armature is in the other position;

alignment compensating means associated with said latch means and adapted to mole upon engagement with the striker bar for aligning said latch means relative to the striker bar to enable said latch means to thereafter lockingly engage the striker bar in a latched position; and biasing means for urging said armature to said first position such that said latch means is urged into a predetermined orientation relative to said alignment compensating means.

2. The solenoid latch apparatus of claim 1 wherein said latch means is adapted to move to said latched position when said armature is in said first position and to an unlatched position when said armature is in said second position, and wherein said alignment compensating means is a movable guide member having a central passage through which said latch means is disposed for translational movement therein upon movement of said armature.

3. The solenoid latch apparatus of claim 2 further comprising means for maintaining a relatively constant air gap between said armature and said pole piece when said latch means is in said latched position.

4. The solenoid latch apparatus of claim 3 wherein said air gap maintaining means comprises coupling means for interconnecting said movable guide member and said pole piece such that movement of said guide member generates corresponding movement of said pole piece such that said biasing means is able to displace said armature in a direction away from said pole piece to maintain said air gap.

5. The solenoid latch apparatus of claim 4 wherein said biasing means includes a first spring disposed between said pole piece and said armature to urge said latch means toward said latched position, and a second spring acting on one of said pole piece and/or said strap member for urging said guide member in a direction toward the striker bar.

6. The solenoid latch apparatus of claim 5 wherein said guide member includes first movement limiting means for limiting the range of movement of said latch means relative to said guide member in a direction toward said latched position, said first movement limiting means permitting a predetermined length of said latch means to extend out of said guide member central passage to define a predetermined orientation between said guide member and said latch means, said guide member adapted to contact the striker bar such that said guide member moves in opposition to said second spring, said latch means adapted to contact the striker bar after said guide member has been moved such that said latch means is urged in a direction opposing said first spring until the striker bar lockingly engages said latch means.

7. The solenoid latch apparatus of claim 6 wherein said guide member further comprises second movement limiting means for limiting the movement of said guide member in a direction toward the striker bar.

8. The solenoid latch apparatus of claim 7 wherein said second spring urges said guide means to contact the striker bar when said latch means is in said latched position to assist in maintaining the striker bar in locking engagement therewith.

9. The solenoid latch apparatus of claim 1 comprising release means for permitting said latch means to be manually disengaged from the striker bar without energization of said winding.

10. A remotely actuated solenoid latch apparatus adapted to be mounted to a motor vehicle structure and engagable with a striker bar, comprising:

a tubular housing;

a solenoid coil assembly fixedly disposed in said tubular housing and defining a longitudinal bore;

a pole piece having a first end portion disposed within said bore;

an armature having a first end portion disposed within said bore and adapted to move axially therein between a first position displaced from said pole piece to a second position attracted toward said pole piece in response to energization of said solenoid coil assembly;

a latch bolt coupled to a second end portion of said armature and adapted for lockingly engaging the striker bar when said armature is in said first position and releasably disengaging the striker bar when said armature is in said second position;

first biasing means for urging said armature toward said first position to define a predetermined air gap between said first end portion of said pole piece and said first end portion of said armature;

a movable guide member having a central passage in which said latch bolt is movably disposed and having movement limiting means for defining a predetermined axial relationship between said guide member and a portion of said latch bolt extending out of said central passage when said armature is in said first position;

coupling means for interconnecting said guide member and said pole piece such that said pole piece is axially movable within said longitudinal bore upon corresponding movement of said guide member; and second biasing means acting on said coupling means for urging said guide member toward an axially protracted position;

said guide member adapted to move to an axially retracted position upon contact with the striker bar in opposition to said second biasing means for compensating for positional variations between said guide member and the striker bar, said movement limiting means maintaining said latch bolt in said predetermined axial relationship relative to said guide member whereby said guide member aligns said latch bolt relative to the striker bar to enable said latch bolt to thereafter contact the striker bar until the striker bar is lockingly engaged by said latch bolt.

11. The solenoid latch apparatus of claim 10 wherein said pole piece is an elongated magnetic member with said first end portion defining a generally frusto-conical tapered surface, said pole piece having a second end forming a reduced cross-section thereby defining a first radially extending shoulder surface.

12. The solenoid latch apparatus of claim 11 wherein said armature is an elongated magnetic member with said first end portion defining a generally frusto-conical tapered surface adapted to matingly engage said frusto-conical tapered surface of said pole piece when said armature is moved to said second position, said latch bolt being coupled to said armature at its opposite end and having a distal end surface adapted to contact the striker bar for moving said latch bolt in a direction opposing said first biasing means.

13. The solenoid latch apparatus of claim 11 wherein said first biasing means is adapted to coact with said movement limiting means such that simultaneous axial movement of said guide member and said latch bolt to said retracted position upon said guide member contacting the striker bar acts to align said distal end surface of said latch bolt relative to the striker bar prior to contact therewith to compensate for alignment variation therebetween.

14. The solenoid latch apparatus of claim 11 wherein said guide member has a first enlarged hollow portion and a second elongated hollow portion defining a second radially extending shoulder therebetween through which said central passage extends, and wherein said movement limiting means comprises said second radially extending shoulder being engagable with a complimentary shoulder surface provided on said latch bolt to limit the axial movement thereof through said central passage to define said predetermined axial orientation between an engaging surface on said second elongated portion of said guide member and said distal end surface of said latch bolt.

15. The solenoid latch apparatus of claim 14 wherein the outer surface of said second portion of said guide member has a reduced cross-section relative to an outer surface of said first enlarged hollow portion thereby defining a third radially extending shoulder surface, said third radially extending shoulder surface adapted to engage the motor vehicle structure to limit the axial protracted movement of said guide member in a direction toward the striker bar.

16. The solenoid latch apparatus of claim 11 wherein said coupling means is a relatively rigid U-shaped magnetic strap member generally surrounding said solenoid coil assembly and having a first end coupled to said pole piece and a second end coupled to said guide member, and wherein said second biasing means is a second helical spring disposed between said first end of said strap member and an inner surface of said housing to urge said guide member in a direction toward said striker bar so as to define a fully protracted position prior to contact with the striker bar.

17. The solenoid latch apparatus of claim 16 wherein said second helical spring urges said guide member into contact with a portion of the striker bar when said latch bolt is in locking engagement therewith to assist in maintaining said air gap.

18. The solenoid latch apparatus of claim 17 wherein said strap member interconnects said guide member and said pole piece such that retracted movement of said guide member upon contact with the striker bar generates corresponding axial movement of said pole piece such that said first biasing means acts to maintain a relatively constant air gap thereby maintaining a relatively constant armature travel which is required to disengage said latch bolt from the striker bar upon energization of said coil assembly.

19. A fuel filler door latch assembly adapted to be mounted to a motor vehicle structure and engagable with a striker bar, comprising:

a housing member defining an inner chamber and having an access opening, said housing adapted to be mounted to the motor vehicle structure;

a door for covering said access opening when said door is in a closed position, the striker bar secured to said door so as to be disposed within said chamber of said housing when said door is in said closed position;

a solenoid actuated latch apparatus extending at least partially into said housing through an aperture therein, said latch assembly including:

a solenoid having an energization coil assembly defining a longitudinal bore;

an armature disposed in said bore and adapted to translate in response to energization of said coil assembly;

pole means for defining a working air gap across which magnetic fields are transferred thereby generating an attracting force between said pole means and said armature which urges said armature to move toward said pole means when said coil assembly is energized;

biasing means for urging said armature away from said pole means when said coil assembly is de-energized;

latch means associated with said movable armature for lockingly engaging the striker bar when said armature is in on of said positions and releasably disengaging the striker bar when said armature is in the other positions; and alignment compensating means associated with said latch means and adapted to move upon engagement with the striker bar for aligning said latch means relative to the striker bar to enable said latch means to thereafter lockingly engage the striker bar in a latched position.

20. The fuel filler door latch assembly of claim 19 wherein said latch means is a latch bolt coupled to said armature such that said latch bolt is adapted to move to a latched position when said coil assembly is de-energized and to an unlatched position when said coil assembly is energized, and wherein said alignment compensating means is a movable guide member having a central passage through which said latch bolt is disposed for translational movement therein upon movement of said armature.

21. The fuel filler door latch assembly of claim 20 further comprising means for maintaining a relatively constant air gap between said armature and said pole means when said latch bolt is in said latched position.

22. The fuel filler door latch assembly of claim 21 wherein said air gap maintaining means comprises a relatively rigid strap member interconnecting said movable guide member and said pole piece such that movement of said guide member upon engagement with the striker bar generates corresponding movement of said pole means such that said biasing means displaces said armature in a direction away from said pole piece.

23. The fuel filler door latch assembly of claim 22 wherein said biasing means includes a first spring disposed between said pole means and said armature to urge said latch bolt toward said latched position, and a second spring acting on one of said pole means and said strap member for urging said guide member in a direction toward the striker bar.

24. The fuel filler door latch assembly of claim 23 wherein said guide member includes first movement limiting means for limiting the range of movement of said latch bolt relative to said guide member in a direction toward said latched position, said first movement limiting means permitting a predetermined length of said latch bolt to extend out of said guide member central passage to define a predetermined axial relationship between said guide member and a terminal end portion of said latch bolt, said guide member adapted to contact the striker bar such that said guide member moves in opposition to said second spring, said terminal end portion of said latch bolt adapted to contact the striker bar after said guide member has been moved such that said latch bolt is urged in a direction opposing said first spring until the striker bar is secured to an engaging surface provided on said latch bolt.

25. The fuel filler door latch assembly of claim 24 wherein said guide member further comprises second movement limiting means for limiting the movement of said guide member in a direction toward the striker bar.

26. The fuel filler door latch assembly of claim 25 wherein said second spring urges said guide member to contact the striker bar when said latch bolt is in said latched position to assist in maintaining the striker bar in locking engagement with said latch bolt engaging surface.

27. A fuel filler door latch assembly adapted to be mounted to a motor vehicle structure and engagable with a striker bar, comprising:

a housing member defining an inner chamber and having an access opening, said housing member adapted to be mounted to the motor vehicle structure;

a pivotable door assembly for covering said access opening when said door assembly is in a closed position, the striker bar secured to said door assembly so as to be disposed within said chamber of said housing member when said door assembly is in said closed position;

a solenoid actuated latch apparatus extending at least partially into said housing member through an aperture therein, said latch assembly including:

a tubular housing;

a solenoid coil assembly fixedly disposed in said tubular housing and defining a longitudinal bore;

a pole piece having a first end portion disposed within said bore;

an armature having a first end portion disposed within said bore and adapted to translate therein between a first position displaced from said pole piece to a second position attracted toward said pole piece in response to energization of said solenoid coil assembly;

a latch bolt associated with a second end portion of said armature and adapted for lockingly engaging the striker bar when said armature is in said first position and releasably disengaging the striker bar when said armature is in said second position;

first biasing means for urging said armature toward said first position to define a predetermined air gap between said first end portion of said pole piece and said first end portion of said armature;

a movable guide member having a central passage in which said latch bolt is movably disposed and having movement limiting means for defining a predetermined axial relationship between said guide member and a portion of said latch bolt extending out of said passage;

strap means for interconnecting said guide member and said pole piece such that said pole piece is axially movable within said longitudinal bore upon corresponding movement of said guide member; and second biasing means associated with said strap means for urging said guide member toward an axially protracted position;

said guide member adapted to move to an axially retracted position upon contact with the striker bar in opposition to said second biasing means for compensating for positional variations between said guide member and the striker bar, said movement limiting means maintaining said latch bolt in said predetermined axial relationship relative to said guide member whereby said guide member aligns said latch bolt relative to the striker bar to enable said latch bolt to thereafter contact the striker bar until the striker bar is lockingly engaged by said latch bolt.

28. The fuel filler door latch assembly of claim 27 wherein said pole piece is an elongated magnetic member having said first end portion defining a generally frusto-conical tapered surface, said pole piece having a second end portion forming a reduced cross-section thereby defining a first radially extending shoulder surface.

29. The fuel filler door latch assembly of claim 28 wherein said armature is an elongated magnetic member with said first end portion defining a generally frusto-conical tapered surface adapted to matingly engage said frusto-conical tapered surface of said pole piece when said armature is moved to said second position, said latch bolt being coupled to said armature at its opposite end and having a distal end surface adapted to move said latch bolt in a direction opposing said first biasing means upon contact with the striker bar.

30. The fuel filler door latch assembly of claim 29 wherein said first biasing means is adapted to coact with said movement limiting means such that said guide member and said latch bolt move substantially concurrently to said retracted position upon said guide member contacting the striker bar for aligning said distal end surface of said latch bolt relative to the striker bar prior to contact therewith to compensate for alignment variation therebetween.

31. The fuel filler door latch assembly of claim 30 wherein said strap means is a relatively rigid U-shaped magnetic strap member surrounding said solenoid coil assembly and having a first end coupled to said pole piece and a second end coupled to said guide member, and wherein said second biasing means is a second spring disposed between said first end of said strap member and an inner surface of said housing to urge said guide member in a direction toward said striker bar so as to define a fully protracted position prior to contact with the striker bar.

32. The fuel filler door latch assembly of claim 31 wherein said strap member interconnects said guide member and said pole piece such that retracted movement of said guide member upon contact with the striker bar generates corresponding axial movement of said pole piece such that said first biasing means acts to maintain a relatively constant air gap thereby maintaining a relatively constant armature travel which is required to disengage said latch bolt from the striker bar upon energization of said solenoid coil assembly.

* * * * *